United States Patent [19]

King et al.

[11] 4,054,466

[45] Oct. 18, 1977

[54] TANNIN TREATMENT OF ALUMINUM

[75] Inventors: Peter F. King, Farmington; Gary A. Reghi, Sterling Heights, both of Mich.

[73] Assignee: Oxy Metal Industries Corporation, Warren, Mich.

[21] Appl. No.: 656,500

[22] Filed: Feb. 9, 1976

Related U.S. Application Data

[63] Continuation-in-part of Ser. No. 612,075, Sept. 10, 1975, abandoned, which is a continuation of Ser. No. 470,424, May 16, 1974, abandoned.

[51] Int. Cl.[2] ..... C23F 7/00

[52] U.S. Cl. ..... 148/6.27; 106/14

[58] Field of Search ..... 148/6.27, 6.15 R; 106/14

[56] References Cited

U.S. PATENT DOCUMENTS

| | | | |
|---|---|---|---|
| 2,146,840 | 2/1939 | Newsome et al. | 148/6.27 |
| 2,502,441 | 4/1950 | Dodd et al. | 148/61.5 R |
| 2,854,368 | 9/1958 | Shreir | 148/6.15 R |
| 3,443,992 | 5/1969 | Schmidt et al. | 134/41 |

FOREIGN PATENT DOCUMENTS

| | | | |
|---|---|---|---|
| 2,246,653 | 5/1975 | France | 148/6.15 R |
| 2,446,492 | 4/1975 | Germany | 148/6.15 R |

*Primary Examiner*—Ralph S. Kendall

*Attorney, Agent, or Firm*—Arthur E. Kluegel; Richard P. Mueller; Bertram F. Claeboe

[57] ABSTRACT

Disclosed are a composition and process useful for the treatment of an aluminum surface comprising contacting the surface with an aqueous solution containing at least 0.000025 weight percent of a vegetable tannin, which solution exhibits a pH of at least 3. Best results can be obtained via a two-stage tanin treatment in which the treating solution of the first stage also contains titanium and fluoride in dissolved form.

20 Claims, No Drawings

TANNIN TREATMENT OF ALUMINUM

CROSS REFERENCE TO RELATED APPLICATIONS

This application is a continuation-in-part of U.S. Ser. No. 612,075 filed Sept. 10, 1975, now abandoned which is in turn a continuation of U.S. Ser. No. 470,424 filed May 16, 1974 and now abandoned.

BACKGROUND OF THE INVENTION

This invention relates to the art of chemically treating an aluminum surface. More specifically, it relates to the art of treating an aluminum surface to improve both the corrosion resistance and the adhesion of an organic finish subsequently applied to the treated surface. This invention also concerns a process for accomplishing the foregoing results with an aqueous solution which has a less detrimental effect upon the environment than conventional treating solutions because it does not require the presence of chromium or phosphate in the solution.

This invention provides an even further advantage in the manufacture and preparation of aluminum cans. The concentration and processing conditions can be adjusted if desired so that the aluminum surface is transformed without the formation of any measurable coating on the surface. Typically, no organic finish is applied to the bottom of aluminum cans. The absence of any substantial coating permits the manufacturer to improve the corrosion resistance of those unfinished portions without changing the appearance of the surface of the aluminum.

In the processing of aluminum cans after forming, the following procedure is typical:

1. wash with warm water;
2. clean, usually with an acid-type cleaner;
3. water rinse;
4. apply treatment chemical;
5. water rinse;
6. deionized water rinse;
7. dry;
8. apply decorative organic finish to the can exterior;
9. cure organic finish at elevated temperature;
10. apply interior sanitary lacquer; and
11. cure interior sanitary lacquer.

For step (4), standard practice is to employ an aqueous solution containing from ½ to 1 weight percent of a mixture of hexavalent chromium, phosphoric acid, and fluoride. Such treating solutions have produced satisfactory quality in terms of both corrosion resistance and paint adhesion. However, the chromium and phosphate components are environmentally objectionable, and their use therefore entails additional recovery or waste treatment expense. It would, therefore, be highly desirable to be able to use a treating solution which would produce acceptable results which did not at the same time create the environmental problem of solutions containing chromium and phosphate.

The use of tannins in connection with metal treating has been suggested by the prior art. U.S. Pat. No. 2,502,441 discloses an alkali metal phosphatizing solution containing a two-component accelerator which may be used for the treatment of iron and steel surfaces and also possibly for other metals such as aluminum. The accelerator portion of the composition contains either a molybdenum or tungsten compound and a phenolic substance such as a tannin. The patentee notes, however, that if the alkali metal phosphate plus tannin is used without the molybdenum compound, deposition of a coating seems to be completely inhibited. U.S. Pat. No. 2,854,368 teaches the use of a phosphoric acid solution containing a tannin for the treatment of iron or steel and also possibly for other metals such as aluminum. The most dilute solution suggested by the patentee is one containing one mole of phosphoric acid per liter and ond weight percent tannin. When this solution was substituted for that of the present invention, completely unsatisfactory organic finish adhesions were obtained.

SUMMARY OF THE INVENTION

It has now been discovered that an aqueous solution containing an effective amount of a vegetable tannin, at least 0.000025 weight percent, when adjusted to a pH of at least 3, will transform an aluminum surface to enhance its corrosion resistance and its receptivity to an organic finish. If coating weights not in excess of 1 mg/ft$^2$ are desired, they may be obtained by using relatively low concentrations and contact times. The term "organic finish" includes, for example, base coat, ink, paint, over-varnish and sanitary lacquer.

Further improvement in surface characteristics are observed if a sequential or two-stage treatment is employed or when the tannin solution additionally contains a soluble titanium compound.

DETAILED DESCRIPTION OF THE INVENTION

The chemistry of tanningagents is not completely understood. They include a large group of water soluble, complex organic compounds widely distributed throughout the vegetable kingdom. All have the common property of precipitating gelatin from solutions and of combining with collagen and other protein matter in hides to form leather. All tannin extracts examined contain mixtures of polyphenolic substances and normally have associated with them certain sugars. (It is not known whether these sugars are an integral part of the structure.) For a discussion of tannins, see *Encyclopedia of Chemical Technology,* 2nd edition, Kirk-Othmer; XII (1967) pp. 303–341 and *The Chemistry and Technology of Leather,* Reinhold Publishing Corporation, New York, pp 98–220 (1958).

Tannins are generally characterized as polyphenolic substances having molecular weights of from about 400 to about 3000. They may be classified as "hydrolyzable" or "condensed" depending upon whether the product of hydrolysis in boiling mineral acid is soluble or insoluble, respectively. Often extracts are mixed and contain both hydrolyzable and condensed forms. No two tannin extracts are exactly alike. Principal sources of tannin extracts include bark such as wattle, mangrove, oak, eucalyptus, hemlock, pine, larch, and willow; woods such as quebracho, chestnut, oak and urunday, cutch and turkish; fruits such as myrobalans, valonia, divi-divi, tera, and algarrobilla; leaves such as sumac and gambier; and roots such as canaigre and palmetto.

The term "vegetable tannins" is employed to distinguish organic tannins such as those listed in the previous paragraph from the mineral tanning materials such as those containing chromium, zirconium and the like. Experimental work has shown that hydrolyzable, condensed, and mixed varieties of vegetable tannins may all be suitably used in the present invention. Quebracho and chestnut have been found to be very effective condensed tannins and myrobalan, an effective hydrolyzable tannin.

Very small concentrations of the tannin extract have been found effective for improving the corrosion resistance and organic finish adhesion of an aluminum surface. The concentration to be used depends upon the particular tannin employed, the processing conditions selected and the quality and thickness of the resulting coating. If all conditions are properly adjusted, concentrations as low as 0.000025 weight percent are effective. Generally, the tannin concentration will be between this lower limit and 25 weight percent and, under the usual conditions, between about 0.002 and .25 weight percent. Most preferably, the concentration will be about 0.025 weight percent. Lower concentrations do not produce an appreciable improvement in characteristics, and higher concentrations result in an increased dragout of valuable chemicals on the workpieces. The pH of the aqueous solution must be adjusted to a value of at least 3 and is preferably less than about 9 and most preferably between 4 and 8. A pH somewhat on the acid side (as low as about 3) is typically obtained when a natural extract is dissolved in water. pH values below 3 do not produce the desired improvement in properties, and there is generally no reason to adjust to a pH above 9. The pH may be adjusted with any compatible acid or base typically used for that purpose such as, hydrochloric, sulfuric, phosphoric, hydrofluoric, nitric, or acetic acids and the alkali metal hydroxides, carbonates or silicates. Only very small amounts are necessary. It is important to note that, while it is permissible to employ small quantities of phosphoric acid to adjust the solution pH, the presence of phoshate ions is totally inessential to the operability of the invention.

The tannin treatment processing conditions of temperature, contact time and contact method are interdependent. Spray, immersion, and roll-on techniques may be employed. Contact times of as low as 0.1 seconds and temperatures of 90° to 150° F are suitable. In the case of can manufacture, application of the chemicals is conventionally by the spray technique and, considering normal plant operations, the temperature of the solution will normaly be from 90° to 150° F, preferably 90° to 125° F (most preferably 100°-105° F) and the contact time will normally be between 0.1 and 30 seconds and preferably between 5 and 30 seconds. Contact times of less than 5 seconds and usually less than one second are required in conduit processing of containers as described, for example, in U.S. Pat. No. 3,748,177 which is incorporated herein by reference. Of course, with suitable adjustment of the solution or processing conditions, values could be outside the above normal ranges.

Aside from the obvious environmental advantages of using the solution of the present invention, a particular advantage in connection with can manufacture is that the treatment conditions can be adjusted to give improved results even though there is formed substantially no measurable coating. By no measurable coating, we mean that the coating weight detectable on the processed can is less than 1 milligram per square foot. The conventional chromium-phosphate treatment for aluminum cans results in a coating weight of between 5 and 15 milligrams per square foot.

In practice, the severest problems of discoloration of an unfinished surface will be encountered during pasteurizing. Typically, no organic finish is applied to the exterior can bottom to protect it from corrosion. If left untreated, it will discolor during pasteurization, turning brownish. The adhesion of the organic finish to the surface normally meets its severest test when the cans are subjected to a hot detergent solution to sanitize the cans before filling or when the surface is scraped during handling.

Where the aluminum is to be employed for architectural applications, the adhesion of the organic finish, e.g., after cold forming is most important.

Aside from the mentioned pH adjuster, additional compatible components may optionally be included in the solution such as accelerators, surfactants and chelating agents. It is advantageous to include a small quantity of a soluble titanium compound at least 0.003%, sufficient to further enhance the effect of the tannin. Examples of suitable titanium compounds include fluotitanic acid, titanium sulfate, titanyl sulfate, and ammonium or alkali metal-halide double salts such as potassium titanium fluoride. The addition of a fluoride compound (simple or complex) is also advantageous. Fluoride acts to promote the reaction between the tannin and the aluminum surface and may also serve to solubilize titanium if desired. Where employed, concentrations of at least 0.006% F are preferred.

Depending upon the qualities required of the final product, further embodiments have been found advantageous. Where a sequential or two-stage treatment is possible, the resulting coating exhibits excellent paint adhesion with a wide variety of paints. Where bare corrosion resistance is critical, (e.g., food or beverage containers) the addition of a lithium compound is beneficial. It has also been found preferable to employ a fluoride containing acid cleaner in advance of the tannin treatment.

The following tests have been employed in the examples to evaluate the quality of the treated surface:

BEND ADHESION

This test is a measure of the ability of a finish to withstand cold deformation after painting. A standard test panel is bent 180° about a mandrel. The radius of curvature at the bend is a function of the mandrel thickness which thickness is expressed in terms of multiples of the test panel thickness. The most severe condition is encountered when no mandrel at all is employed and the panel is simply bent back upon itself (O-T Bend). paint adhesion is then determined by application and removal of Scotch-brand transparent tape (No. 610) from the bend and the proportion of paint remaining is rated from 10 (100% adhesion) to 0 (0% adhesion).

IMPACT

This test is designed to show the effect upon paint adhesion of an impact deformation. A ⅝ inch diameter tool is impacted on the unpainted side of a panel. The force of the impact is approximately 2000 times the panel thickness (e.g., 50 inch-lbs. for a panel 0.025 inch thick). The standard impact test is performed shortly after the paint is cured and at ambient temperatures. A "Cold impact" is performed on a painted panel which has been refrigerated to a temperature of 15° F or less. A "Delayed Cold Impact" is performed on a panel at least 5 days after painting. In any impact test, adhesion is measured by the application and removal of Scotch-brand transparent tape to the deformed surface and the proportion of paint remaining on the surface is rated from 10 (100% adhesion) to 0 (0% adhesion).

MEK RESISTANCE

This test is employed by paint manufacturers as a measure of the degree of cure of a paint. A cloth soaked with methyl ethyl ketone is rubbed briskly back and forth over the painted surface. The number of back and forth rubs required to completely remove the paint over a 10 mm length is recorded. 100 or more rubs are normally required for acceptability.

PASTEURIZATION

This test is a measure of the resistance to discoloration of a substrate which has been treated but to which no organic finish has been applied. The treated surface is immersed in tap water at 140°-160° F (60°-70° C) for 45 minutes. The surface is then observed for discoloration and rated relatively from 1 for no discoloration to 5 for severe discoloration.

SCRAPE ADHESION

This test is a measure of the adhesion between an organic finish and a substrate. The painted surface is subjected to a standard 1% detergent solution (Joy; Proctor & Gamble) at boiling for 30 minutes, water rinsed and dried. Then, a sharp edge is drawn along the surface to determine the adhesion of paint under these conditions. The results are rated relatively from 1 for excellent adhesion to 5 for very poor adhesion.

TAPE ADHESION

This test is a measure of the adhesion between an organic finish and a treated substrate. The painted surface is subjected to a standard 1% detergent solution (Joy; Proctor & Gamble) at boiling for 30 minutes, rinsed in tap water, cross-hatched (approximately 64 squares/sq. inch), and dried. Scotch-brand transparent tape is then applied to the cross-hatched area and the amount of paint removed by the tape is observed. Results are rated relatively from 1 (less than 1% removal) to 5 (almost complete removal) or in terms of % peel.

The following examples demonstrate the invention using varying concentrations and pH values for different types of vegetable tannins.

EXAMPLE 1

CONDENSED TANNIN

Solutions containing 0.001, 0.002, 0.012, 0.025, 0.25 and 0.5 weight percent quebracho powder extract at pH = 7.7 -7.9 were used to treat aluminum cans. The following process sequence was used:

1. 15 sec. hot water rinse;
2. 30 sec. spray cleaning using a sulfuric acid-based cleaner;
3. 15 sec. hot water rinse;
4. 20 sec. spray treatment at 100°-105° F with the quebracho solution;
5. 15 sec. cold water rinse;
6. 3 min. oven dry at 350° F.

An organic finish was then applied to the exterior side walls of the thus-treated aluminum cans as follows:

Coke red ink (Acme Ink Co. alkyd-based) was applied using rubber rolls. A clear overvarnish (Clement Coverall Co., Code No. P-550-G alkyd polyester) was then applied over the wet ink using a No. 5 draw down bar. The cans were then baked 5 min. at 350° F followed by 3 min at 410° F to cure.

Tape adhesion was then evaluated, and the peel results are summarized in Table I.

TABLE I

| Weight Percent Quebracho | Exterior Finish Tape Adhesion | |
|---|---|---|
| .001 | Poor | 90 - 100% Peel |
| .002 | Excellent | 0% Peel |
| .012 | Excellent | 0% Peel |
| .025 | Excellent | 0% Peel |
| .25 | Excellent | 0% Peel |
| .5 | Excellent | 0% Peel |

For comparison, aluminum cans were also treated with a commercially accepted $CrO_3$ — $H_3PO_4$—HF solution of the type described above to obtain about 6 mg/ft$^2$ coating weight. When finished and tested as above, excellent paint adhesion with 0% peel was obtained. Aluminum cans were also prepared without either the tannin or chromium based treatment (cleaned and water rinsed only). When finished and tested as above, poor adhesion with 100% peel resulted.

The bottoms of the treated aluminum cans were subjected to the Pasteurization test. No discoloration was observed with the commercially accepted $CrO_3$—$H_3PO_4$—HF treatment. A commercially acceptable very slight discoloration was observed on the can bottoms treated with the quebracho solutions. The untreated aluminum can bottoms showed a greater and commercially unacceptable degree of discoloration.

EXAMPLE 2

HYDROLYZABLE TANNIN

A solution was prepared by dissolving 6 gm of "Tannic Acid" (nutgall extract) in 6 liters of water which gave a pH of 6.20. The Tannic Acid was supplied by Merck & Co. Inc. and labeled N. F. Fluffy. The pH of the Tannic Acid solution was adjusted by using very small amounts of $H_3PO_4$ and/or NaOH. Aluminum cans were processed at pH's of 8.65, 6.20, 4.40 and 2.70 using the following process sequence:

1. 60 sec. spray cleaning using a sulfuric acid-based cleaner;
2. 30 sec. hot water rinse;
3. 20 sec. spray treatment at 120° F with the Tannic Acid solution;
4. 30 sec. cold water rinse;
5. 3 min. oven dry at 250° F.

The cans were then finished and tested as in Example 1. Results were as shown in Table II.

TABLE II

| Tannic Acid Solution pH | Exterior Finish Tape Adhesion | |
|---|---|---|
| 8.65 | Excellent | 0% Peel |
| 6.20 | Excellent | 0% Peel |
| 4.40 | Excellent | 0% Peel |
| 2.70 | Poor | 100% Peel |

EXAMPLE 3

CONDENSED TANNIN

A solution consisting of 0.025% quebracho at pH values of 8.60, 5.06 and 2.73 was used to treat aluminum cans. The pH of the quebracho solution was adjusted to the desired value using small amounts of $H_3PO_4$ and/or NaOH. The following process sequence was used to treat the aluminum cans.

1. 60 sec. spray cleaning using a sulfuric acid-based cleaner;
2. 30 sec. hot water rinse;

3. 20 sec. spray treatment at 100° F with the quebracho solution;
4. 30 sec. cold water rinse;
5. 3 min. oven dry at 250° F.

The cans were finished as in Example 1 and then a sanitary lacquer (Mobil Paint Co. No. S-6839009 thermosetting vinyl) was applied to the can interior with a No. 20 draw down bar and cured for 3 minutes at 410° F. Exterior tape adhesions are shown in TABLE III.

TABLE III

| Quebracho Solution pH | Exterior Finish Tape Adhesion | |
|---|---|---|
| 8.60 | Excellent | 0% Peel |
| 5.06 | Excellent | 0% Peel |
| 2.73 | Poor | 100% Peel |

The interior surface of the can having only the clear, sanitary lacquer applied to the treated surface was also tested for adhesion as above and 0% peel was observed. Untreated cans exhibited peels as high as 25%.

EXAMPLE 4

HYDROLYZABLE TANNIN

A solution was prepared by dissolving 6 gm of myrobalan extract in 6 liters of water which gave a pH of 3.7. The myrobalan was manufactured by Tannins and Chemicals, Inc. and labeled "Spray Dried Myrobalan Powder 60%". An aluminum can was processed in this solution using the following process sequence:

1. 60 sec. spray cleaning using a sulfuric acid-based cleaner;
2. 30 sec. hot water rinse;
3. 20 sec. spray treatment at 120° F with the myrobalan solution;
4. 30 sec. cold water rinse;
5. 3 min. oven dry at 350° F.

The same procedure as in Example 1 was used to finish and test the can. Excellent adhesion with 0% peel was obtained.

EXAMPLE 5

An aqueous solution was prepared to contain:

| Component | Concentration g/l |
|---|---|
| HF | 1.0 as F |
| $TiOSO_4$ | 0.14 as Ti |
| Chestnut Tannin Extract | 0.15 |

The pH of the prepared solution was 5. Aluminum cans were then procesed according to the cycle:

1. 15 sec. hot water rinse;
2. 30 sec. acid cleaner;
3. 15 sec. hot water rinse;
4. 20 sec. spray application of treating solution, 120° F;
5. 15 sec. cold water rinse;
6. 15 sec. deionized water rinse;
7. 3 min. oven dry at 350° F.

Separate coupons or panels were cut from each can and processed further as follows:

Coupon A

1. Apply transparent ink (Acme Ink Co.) to exterior surface.
2. Apply clear overvarnish (Clement Coverall Co., Code P-550-G alkyd-polyester) over the wet ink using a No. 5 draw down bar.
3. Bake 5 minutes at 350° F.
4. Bake 3 minutes at 410° F (to simulate curing of sanitary interior lacquer).

Coupon B

1. Apply sanitary interior lacquer (Mobil S-6839-009, vinyl-based) to interior surface.
2. Bake 3 minutes at 410° F.

Both the interior and exterior surfaces were then tested for Tape and Scrape Adhesion and subjected to the Pasteurization test for discoloration of the unpainted surfaces.

Cans treated with the above solution gave a rating of 1 for exterior and interior adhesions in accordance with both the Scrape and Tape Adhesion testing procedures. Only slight discoloration was observed in the Pasteurization test.

By comparison, cans which were cleaned and then painted without further treatment exhibited a 5 (very poor) Scrape Adhesion rating on the exterior and exhibited an unacceptable very dark discoloration in the Pasteurization test.

EXAMPLE 6

A basic processing cycle for aluminum panels was established as follows:

1. 10 sec. alkaline cleaner, 120° F;
2. 10 sec. hot water rinse;
3. 5 sec. spray application of treating solution, 120° F, pH=5;
4. 10 sec. cold water rinse;
5. 3 sec. post-treatment (0.025% Quebracho tannin, pH 4.5).

Identical aluminum panels were processed through four variations of the above process cycle:

A. CLEAN ONLY — Panels are cleaned, water rinsed and painted, omitting steps 3, 4 and 5.

B. SINGLE-STAGE TANNIN TREATMENT — Panels are treated omitting steps 3 and 4.

C. TWO-STAGE TANNIN TREATMENT — Panels are treated according to the basic process employing an aqueous solution of 0.015 wt. % chestnut tannin extract in Step 3.

D. MODIFIED TWO-STAGE TANNIN TREATMENT — Panels are treated according to the basic process employing in Step 3 an aqueous solution of 0.015 wt. % chestnut tannin, 0.014% Ti (added as $TiOSO_4$) and 0.1% F (added as HF).

Separate sets of the thus-treated panels were then painted with the following paints:

| Paint | Supplier |
|---|---|
| Polyester (#71308 Poly-Lure 2000) | Glidden |
| Acrylic enamel (Duracron Super 630) | PPG |
| Modified epoxy (8-C-2002) | Technical Coatings Co. |
| Vinyl (1401-3706-11) | Bradley-Vrooman |

The thus-painted panels were then subjected to physical testing in accordance with the Bend, Cold and Delayed Cold Impact and MEK tests. The panels which had been cleaned only (variation A) failed in almost all physical testing. Where a tannin solution was employed (Variations B, C, D), results improved markedly. Two-stage tannin tratment (Variations C,D) exhibited further improvement with best results obtained in the modified two-stage treatment (Variation D).

TABLE IV

| Process Variation | Paint Type: Polyester O-T Bend | Polyester MEK | Acrylic O-T Bend | Acrylic MEK | Epoxy O-T Bend | Epoxy MEK | Vinyl 0-T Bend | Vinyl Delayed Cold Impact |
|---|---|---|---|---|---|---|---|---|
| A | 9.5 | 26 | 0 | 65 | 8 | 100+ | 1 | 1 |
| B | 10 | 100+ | 10 | 100+ | 10 | 100+ | 9 | 4 |
| C | 10 | 100+ | 9.5 | 100+ | 10 | 100+ | 9.8 | 5 |
| D | 10 | 100+ | 9.5 | 100+ | 10 | 100+ | 10 | 10 |

What is claimed is:

1. A process for the treatment of an aluminum surface to transform the surface to improve both the corrosion resistance of the surface and the adhesion of an organic finish to be subsequently applied to the treated surface comprising contacting the surface with an aqueous solution consisting essentially of at least 0.000025 weight percent of a vegetable tannin which solution exhibits a pH of from 3 to 9.

2. The process of claim 1 wherein the tannin concentration is at least about 0.002 weight percent, the temperature of the solution is at least 90° F and the contact time is at least 0.1 seconds.

3. The process of claim 2 wherein the solution temperature is between 90° and 150° F and the pH is from 4 to 8.

4. The process of claim 1 wherein said tannin is an extract of a naturally occurring tannin substance.

5. The process of claim 1 wherein the solution is substantially phosphate free.

6. In a process for preparing an aluminum surface to receive an organic finish wherein the surface is first cleaned, water rinsed, treated and water rinsed again, the improvement comprising contacting the surface with the solution of claim 1 to accomplish said treatment.

7. The process of claim 1 wherein the aqueous solution additionally contains fluoride ion, free or complexed, in an amount sufficient to improve the corrosion resistance and adhesion of an organic finish to the surface.

8. The process of claim 1 wherein the aqueous solution additionally contains a titanium compound in an amount sufficient to further improve the corrosion resistance and adhesion of an organic finish to the surface.

9. The process of claim 8 wherein the aqueous solution additionally contains fluoride ion, free or complexed, in an amount sufficient to improve the corrosion resistance and adhesion of an organic finish to the surface.

10. In a process for preparing an aluminum surface to receive an organic finish comprising cleaning, treating and post-treating, the improvement comprising contacting the surface with an aqueous composition consisting essentially of at least 0.000025 weight percent of a vegetable tannin which composition exhibits a pH of from 3 to 9 to accomplish said treatment and thereafter contacting the surface with a second composition consisting essentially of at least 0.000025 weight percent vegetable tannin and exhibiting a pH of 3 to 9 to accomplish said post-treatment.

11. The process of claim 10 comprising at least one intervening water rinse.

12. The process of claim 10 wherein with respect to the treating step, the tannin concentration is at least about 0.002 weight percent, the temperature of the solution is at least 90° F and the contact time is at least 0.1 seconds.

13. The process of claim 12 wherein the treating solution temperature is between 90° and 150° F and the pH is from 4 to 8.

14. The process of claim 10 wherein each tannin is an extract of a naturally occurring tannin substance.

15. The process of claim 10 wherein the solutions are substantially phosphate free.

16. The process of claim 10 wherein the aqueous treating solution additionally contains fluoride ion, free or complexed, in an amount sufficient to improve the corrosion resistance and adhesion of an organic finish to the surface.

17. The process of claim 10 wherein the aqueous treating solution additionally contains a titanium compound in an amount sufficient to further improve the corrosion resistance and adhesion of an organic finish to the surface.

18. The process of claim 17 complexed, the aqueous solution additionally contains fluoride ion, free or comlexed, in an amount sufficient to improve the corrosion resistance and adhesion of an organic finish to the surface.

19. An aqueous phosphate-free composition exhibiting a pH of from 3 to 9 and consisting essentially of a vegetable tannin and a soluble titanium compound in amounts sufficient to improve the corrosion resistance and organic finish adhesion of an aluminum surface contacted with the composition.

20. The composition of claim 19 further comprising fluoride ion in an amount sufficient to imrove the corrosion resistance and organic finish adhesion of an aluminum surface contacted with the composition.

* * * * *